US005339787A

United States Patent [19]

Jungquist et al.

[11] Patent Number: 5,339,787

[45] Date of Patent: Aug. 23, 1994

[54] METHOD AND APPARATUS FOR DISTRIBUTING FUEL IN A DIESEL ENGINE

[75] Inventors: Bruce E. Jungquist, Aurora, Ohio; Michael E. McBroom, Rochester, N.Y.; Curtis G. Yaeger, Prior Lake, Minn.; Donald G. Knauff, Lakeville, Minn.; Thomas R. Sem, Plymouth, Minn.

[73] Assignee: Westinghouse Electric Corporation, Pittsburgh, Pa.

[21] Appl. No.: 23,275

[22] Filed: Feb. 26, 1993

[51] Int. Cl.[5] ..... F02M 37/04

[52] U.S. Cl. ..... 123/514; 123/516; 123/510

[58] Field of Search ..... 123/510, 514, 516, 509, 123/456

[56] References Cited

U.S. PATENT DOCUMENTS

| | | | |
|---|---|---|---|
| 2,878,889 | 3/1959 | Gilbert | 123/516 |
| 3,444,871 | 5/1969 | McClure . | |
| 4,454,848 | 6/1984 | Duprez | 123/514 |
| 4,454,851 | 6/1984 | Bourbonnaud | 123/514 |
| 4,459,964 | 7/1984 | Straubel | 123/514 |
| 4,625,701 | 12/1986 | Bartlett | 123/516 |
| 4,763,633 | 8/1988 | Nakanishi | 123/514 |
| 4,960,088 | 10/1990 | Havemann et al. . | |
| 4,989,572 | 2/1991 | Giacomazzi | 123/514 |
| 5,074,272 | 12/1991 | Bostick | 123/514 |
| 5,085,198 | 2/1992 | Bartlett | 123/514 |
| 5,095,876 | 3/1992 | Yonekawa | 123/516 |

FOREIGN PATENT DOCUMENTS

| | | | |
|---|---|---|---|
| 0041630 | 4/1978 | Japan | 123/516 |
| 0091363 | 5/1983 | Japan | 123/514 |
| 0712525 | 1/1980 | U.S.S.R. | 123/510 |
| 8801346 | 2/1988 | World Int. Prop. O. | 123/514 |

OTHER PUBLICATIONS

Defensive Publication T 946,011, McClure et al. 946 O.G. 10 published May 4, 1976.

*Primary Examiner*—Carl S. Miller

[57] ABSTRACT

A diesel engine system in which fuel in a fuel tank having an air space above a fuel level is pumped to a fuel injection system disposed in spaced relation above the fuel tank, and excess fuel is returned to the fuel tank air space via an uninterrupted fluid flow path between the injection system and the air space of the fuel tank. The fluid flow path has a cross sectional area selected such that air from the fuel tank air space flows counter to fuel returning to the fuel tank by gravity during non-operation of the diesel engine, to maintain the space vacated by returning fuel near atmospheric pressure. A method embodiment includes the steps of providing an uninterrupted fluid flow return path between the injection system and the air space of the fuel tank, and sizing the fluid flow return path such that, during non-operation of the diesel engine, air from the fuel tank air space flows counter to fuel returning to the fuel tank by gravity, to maintain the space vacated by returning fuel near atmospheric pressure.

15 Claims, 2 Drawing Sheets

METHOD AND APPARATUS FOR DISTRIBUTING FUEL IN A DIESEL ENGINE

TECHNICAL FIELD

The invention relates in general to diesel engine systems, and more specifically to methods and apparatus for distributing fuel in a diesel engine system.

BACKGROUND ART

Diesel engines have been used for many years as the prime mover for refrigerant compressors in transport refrigeration systems, including transport refrigeration systems used for tractor trailer combinations and straight trucks. Diesel engines associated with transport refrigeration systems utilized with tractor trailers have experienced minimal starting problems attributable to prolonged inactivity, such as over night, or over a week end. On the other hand, diesel engines used in straight truck applications of transport refrigeration systems have often experienced starting problems after a period of inactivity.

With the availability of refrigeration controls which automatically start the diesel engine prior to the arrival of truck loading personnel, so the conditioned space will be at or near the desired set point temperature when the truck is loaded, it is becoming more important to solve the starting problem associated with diesel engines included as part of transport refrigeration systems used on straight trucks.

SUMMARY OF THE INVENTION

Briefly, the present invention includes the discovery that fuel returning from the diesel engine fuel injection system to the fuel tank by gravity, during a period of inactivity, creates a partial vacuum in the injection system. The extent to which the pressure is lowered in the injection system is directly proportional to the height of the diesel engine above the fuel tank. It has been found that when the elevational difference exceeds about four feet, a sufficient lowering of pressure occurs in the injection system to pull a detrimental amount of air into an injection system which has one or more minute air flow paths through the various fittings associated therewith. Thus, whether or not a diesel engine elevated more than four feet above the fuel tank will experience difficult starting problems after a period of inactivity depends upon the air tightness of the injection system. An injection system which is air tight when manufactured may develop minute air leaks during over-the-road use of such systems, and thus an engine which initially experiences no starting problems due to inactivity, may develop such starting problems after a period of over-the-road usage.

Diesel engines associated with transport refrigeration systems used on a tractor-trailer combinations are usually mounted less than four feet above the fuel tank, accounting for the fact that they have experienced few starting problems attributable to a period of inactivity. On the other hand, it is common to mount transport refrigeration systems high on the nose of a straight truck, with the diesel engine often being ten to twelve feet above a fuel tank mounted under the truck body. An elevational difference of this magnitude produces a dramatic drop in pressure in the injection system of a non-operating diesel engine, drawing sufficient air into an injection system which is not air tight to cause a starting problem.

In recognition of the cause of the problem, the invention provides an uninterrupted flow path between the injection system and the air space of the fuel tank. The common practice of returning the fuel below the fuel level to maintain a "warm" pool of fuel in the tank should not be used. Additionally, the cross sectional area of the return flow path is increased over that which is conventionally used, such that the cross sectional area relative to the rate at which fuel may be returned always provides sufficient capacity in the return path to enable air from the fuel tank air space to flow counter to the returning fuel, to maintain the space vacated by the returning fuel at, or near, atmospheric pressure at all times, preventing the drawing of a detrimental amount of air into the injection system.

More specifically, the invention includes a diesel engine system in which fuel is pumped from a fuel tank having an air space above a fuel level to a fuel injection system disposed in spaced relation above the fuel tank. Excess fuel is returned to the fuel tank via fuel return line means which defines an uninterrupted fluid flow path between the injection system and the air space of the fuel tank. The return line means has a cross sectional area selected to enable air from the fuel tank air space to flow counter to fuel returning to the fuel tank by gravity during non-operation of the diesel engine, to maintain the space vacated by returning fuel near atmospheric pressure.

In one embodiment of the invention, the fuel return line means includes first and second fuel line conduits connected in parallel between the fuel injection system and the air space of the fuel tank. This creates a large ratio of cross-sectional area of the return path to the fuel tank air space to the cross sectional area of the fuel return path to a fuel filter assembly. In a preferred embodiment of the invention the large ratio is provided by return line means which includes a single return line conduit connected between the injection system and the air space of the fuel tank, and restriction means in the return line means which restricts the rate at which fuel is returned to the fuel filter assembly, with the cross sectional areas of the single return line conduit and restriction means cooperatively maintaining the space vacated by returning fuel near atmospheric pressure by enabling air from the air space of the fuel tank to flow counter to returning fuel.

The invention also includes a method of distributing fuel in a diesel engine system in which fuel in a fuel tank having an air space above a fuel level is pumped, during operation of the engine, to a fuel injection system disposed in spaced relation above the fuel tank, and excess fuel is returned to the fuel tank. The method includes the steps of providing fuel return line means which defines an uninterrupted fluid flow path between the injection system and the air space of the fuel tank, returning fuel to the air space of the fuel tank via the fuel return line means, and sizing the cross sectional area of the return line such that, during non-operation of the diesel engine, air from the fuel tank air space flows counter to fuel returning to the fuel tank by gravity, to maintain the space vacated by returning fuel near atmospheric pressure.

In one embodiment of the method, the step of sizing the cross sectional area of the return line means includes the step of providing an additional return line conduit from the fuel injection system to the air space of the fuel tank, in parallel with the conventional fuel line conduit supplied as original equipment. In a preferred embodiment of the method the step of sizing the return line means includes the step of providing a single return line conduit between the injection system and the air space of the fuel tank, providing a restriction in a portion of the return line means which returns fuel to a fuel filter assembly, and sizing the cross sectional area of the single return line conduit such that the sizing of the single return line conduit and the step of providing a restriction in the return line means cooperatively maintain the space vacated by returning fuel near atmospheric pressure.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
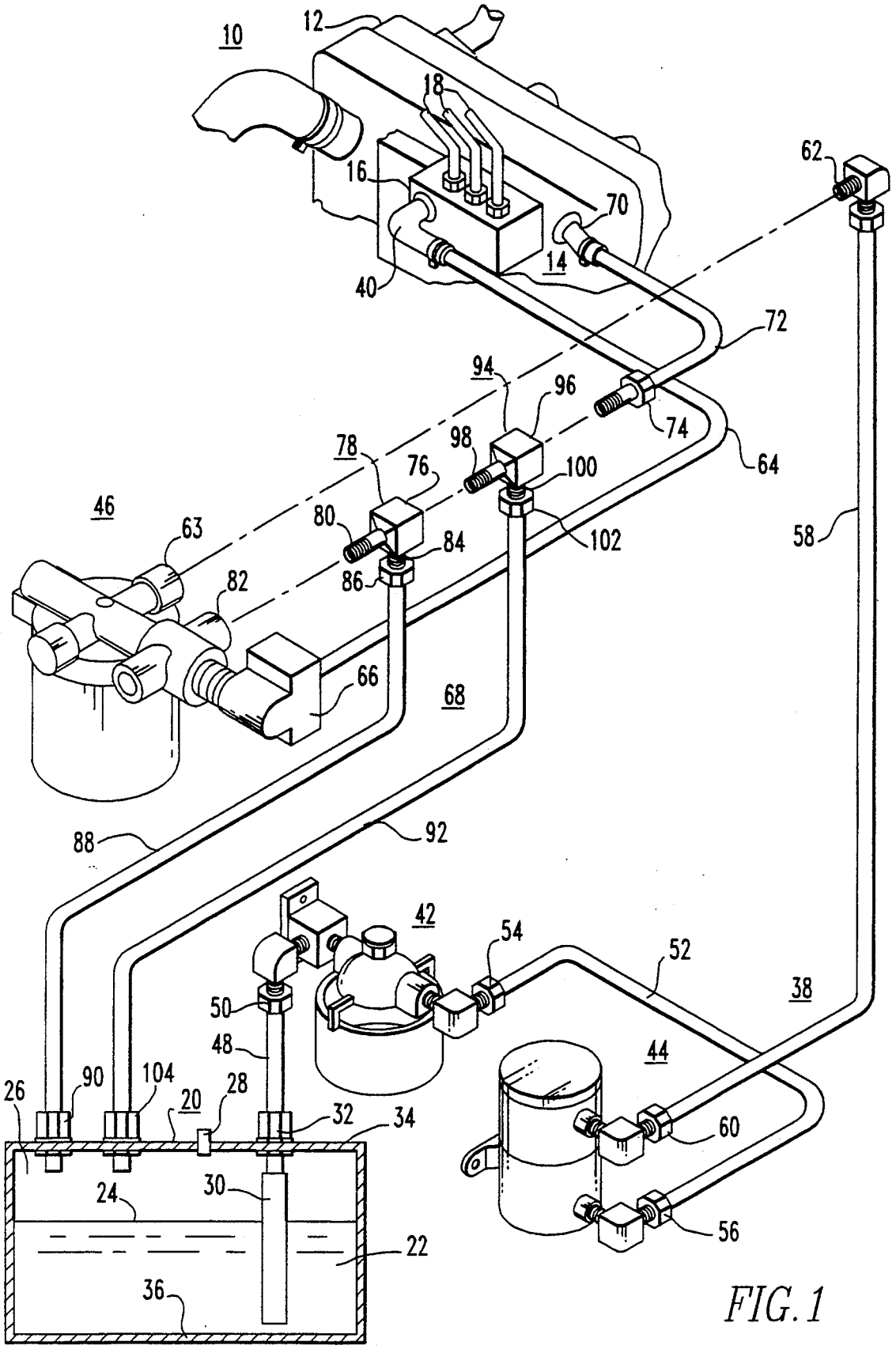
FIG. 1 is a partially exploded perspective view of a diesel engine fuel distribution system constructed according to a first embodiment of the invention.

Referring now to the drawings, and to FIG. 1 in particular, there is shown a diesel engine system 10 constructed according to a first embodiment of the invention. Diesel engine system 10 includes a diesel engine 12 having a fuel injection system 14. Fuel injection system 14 includes an injection pump 16 which pumps diesel fuel to the cylinders of engine 12 via a plurality of injection lines 18.

Diesel engine system 10 includes a fuel tank 20 which, as illustrated in the Figures, is mounted well below the fuel injection system 14 in most applications of transport refrigeration systems, such as ten to twelve feet in a straight truck application. Fuel tank 20 contains diesel fuel 22 having a level 24. Fuel tank 20 defines an air space 26 above fuel level 24, with air space 26 being vented to the atmosphere via a vent 28. A standpipe 30 extends from a fitting 32 on an upper tank wall 34 to near the bottom 36 of tank 20.

A fuel delivery or supply system 38 extends from tank fitting 32 to a fitting 40 on the injection pump 16. Fuel supply system 38 includes a fuel pre-filter assembly 42, a fuel pump assembly 44, a fuel filter assembly 46, and interconnecting fuel supply line conduits. The fuel supply line conduits, which may be 0.375 inch (9.5 mm) conduits, for example, include a conduit 48 which extends from tank fitting 32 to an input fitting 50 on fuel pre-filter assembly 42, a conduit 52 which extends from an output fitting 54 on fuel pre-filter assembly 42 to an input fitting 56 on the fuel pump assembly 44, a conduit 58 which extends from an output fitting 60 on the fuel pump assembly 44 to an input fitting 62 which connects to an input port 63 on fuel filter assembly 46, and a conduit 64 which extends from an output fitting 66 on fuel filter assembly 46 to the input fitting 40 of the fuel injection system 14.

A fuel return arrangement 68 for excess fuel supplied to the fuel injection system 14 extends from a fitting 70 associated with the fuel injection system 14 to fuel tank 20. The fuel return arrangement 68 will first be described as it is conventionally constructed in prior art diesel engine systems, and then modifications according to the teachings of the invention will be described.

More specifically, fuel return arrangement 68 includes a conduit 72 having a fitting 74 which normally engages an input end 76 of a tee 78. A first output end 80 of tee 78 engages an input port 82 of filter assembly 46 which returns some of the excess fuel to the filter assembly 46 for return to the injection system 14. A second output end 84 engages a fitting 86 of a return line conduit 88 which extends to a fuel tank fitting 90. Thus, a portion of the excess fuel is returned to fuel tank 20. It is conventional to connect tank fitting 90 to a standpipe to return warmed fuel below fuel level 24, and thus maintain a warm pocket of fuel around the bottom end of the standpipe. According to the teachings of the present invention, excess fuel is returned to air space 24, and thus the conventionally used return standpipe is eliminated. Since the fuel 22 delivered through the supply conduits, which may be 0.375 inch (9.5 mm) conduits, is partially consumed by engine 12, and a portion of the excess fuel is recirculated back to injection system 14 via filter assembly 46, the fuel return line 88 conventionally has a much smaller cross sectional area than the cross sectional area of the supply conduits, such as supply conduit 58. Thus, when the supply conduits are 0.375 inch (9.5 mm) conduits, the return line 88 may be 0.25 inch (6.3 mm), for example.

Inactivity of diesel engine system 10 for an extended period of time, such as over night, or over a week end, allows fuel from the injection system 14 to leak back to fuel tank 20 via return line 88. With a 0.25 inch (6.3 mm) return line 88, and a return line standpipe connected to tank fitting 90, a partial vacuum is created in injection system 14 when fuel leaks back to fuel tank 20. When injection system 14 is elevated above fuel tank 20 by a dimension which exceeds about four feet, the partial vacuum becomes great enough to pull air through any minute openings in injection system 14, such as at the joints of the many fittings associated therewith, and this air may then cause problems in starting engine 12, often requiring manual bleeding of the air from the injection system 14.

When the cause of the starting problem was recognized, it was solved by providing a fuel return flow path from the injection system 14 to the air space 26 of the fuel tank 20 of sufficient capacity such that as the fuel leaks from injection system 14 to fuel tank 20 by gravity during non-operation of engine 12, air from fuel tank air space 24 flows counter to the returning fuel, thus maintaining the volume vacated by the leak-back fuel at, or near, atmospheric pressure, eliminating the problem of drawing air into a portion of the injection system 14 which may cause an air block and thus hard starting.

FIG. 1 illustrates a first successful embodiment of the invention, wherein, in addition to the conventional fuel return line 88, a second or additional fuel return line conduit 92 is provided which is connected in parallel with the conventional fuel return line conduit 88. An additional or second tee 94 is provided having an input end 96 and first and second output ends 98 and 100. Tee 94 has its input end 96 connected to fitting 74 of conduit 72 and its output end 98 is engaged with the input end 76 of tee 78. The additional return line conduit 92 includes a fitting 102 which engages the second output end 100 of tee 94, and the additional return line conduit 92 is further connected to a second or additional tank fitting 104. The additional tank fitting 104, similar to the first tank fitting 90, returns excess fuel to air space 26. The second or additional return line conduit 92 is selected such that the combined return flow path cross sectional areas of the parallel connected return lines 88 and 92 provides ample flow capacity to provide the required flow of air from air space 26 counter to the flow of returning fuel during a period of engine inactivity, to maintain the volume vacated by the returning fuel at, or near, atmospheric pressure, with a successful embodiment utilizing a 0.375 inch (9.5 mm) return line conduit 92 along with a 0.25 inch (6.3 mm) conventional return line conduit 88. Thus, in the embodiment of FIG. 1, the total cross sectional area of the fuel return lines 88 and 92, in a preferred embodiment, exceeds the cross sectional area of the supply line conduit 58.

Figures 2, 3:
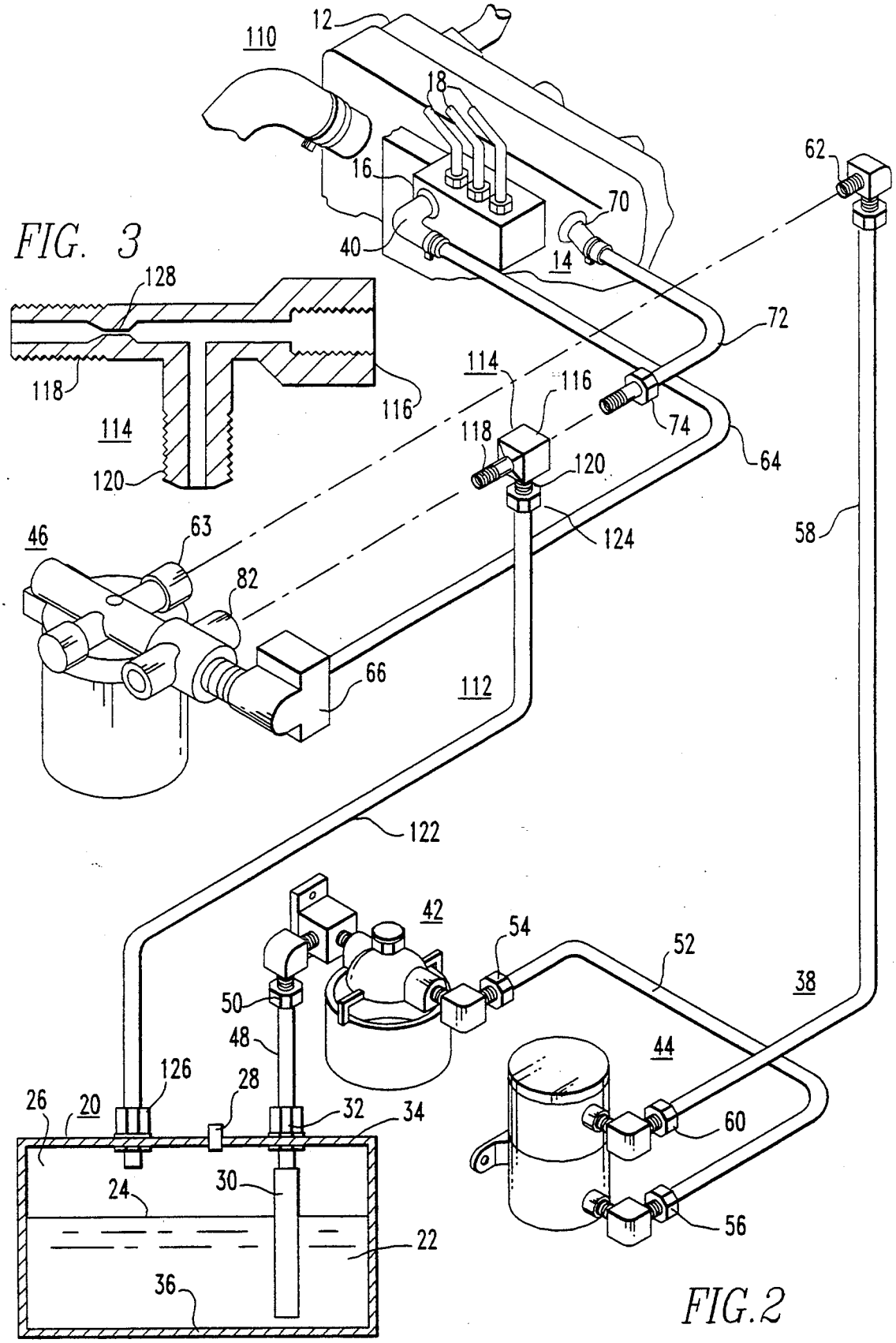
FIG. 2 is a partially exploded perspective view of a diesel engine fuel distribution system constructed according to another embodiment of the invention.
FIG. 3 is a sectional view of a restriction device shown in FIG. 2, which restricts the rate at which fuel is allowed to return to a fuel tank by gravity during non-operation of the associated diesel engine.

While the embodiment of the invention illustrated in FIG. 1 solves the difficult starting problem due to fuel leak- back during a prolonged period of inactivity of engine 12, it requires a second fuel return line conduit 92, and a second fuel tank fitting (104). FIG. 2 illustrates a second embodiment of the invention, which requires only a single return line and a single return line tank fitting, and thus is less costly to manufacture and assemble. Like reference numbers in FIGS. 1 and 2 indicate like components which will not be described again.

More specifically, FIG. 2 illustrates a diesel engine system 110 which is similar to diesel engine system 10 except it utilizes a fuel return arrangement 112 which differs from the fuel return arrangement 68 illustrated in FIG. 1. Fuel return arrangement 112 utilizes a single tee 114 having an input end 116 and first and second output ends 118 and 120, and a single return line conduit 122. Fitting 74 of fuel return line conduit 72 engages the input end 116 of tee 114, and the first output end 118 of tee 114 engages input port 82 of filter assembly 46. Return line conduit 122 includes a fitting 124 which engages the second output end 120 of tee 114, and the remaining end of the single return line conduit 122 terminates in a tank fitting 126 which returns fuel to fuel tank air space 26.

In the embodiment of FIG. 1, the cross sectional area of the two return lines 88 and 92 is selected to provide the required counter air flow with regard to the normal rate of fuel leak-back which may occur, without a deliberate attempt to modify conventional excess fuel return rate to the fuel filter assembly. In the embodiment of FIG. 2, a restriction is provided in the return line branch between the injection system and the fuel filter assembly 46, with the return line 122 being connected between the restriction and the injection system 14. The restriction enables the return flow path defined by return line conduit 122 to have a smaller cross sectional area than in the first embodiment and still retain the desired flow rate ratio between the two branches of the fuel return path of the first embodiment.

FIG. 3 is a cross sectional view of tee 114 constructed to restrict the flow rate to the fuel filter assembly 46, by incorporating a restriction or bleed orifice 128 in output branch 118 of tee 114. A 0.020 inch (0.5 mm) bleed orifice has been found to work well when a 0.375 inch (9.5 mm) return line conduit 122 is utilized, for example, but other combinations of bleed orifice dimensions and return line dimensions may be utilized. The bleed orifice dimension and return line dimension are thus selected to cooperatively provide the return fuel flow capacity characteristics which create the required counter flow of air from fuel tank air space 26 to enable the volume vacated by the returning fuel to be maintained at a pressure which will not pull air into critical areas of the injection system 14. Thus, in the embodiment of FIG. 2, the cross sectional area of the return line conduit 122 may be substantially the same as the cross sectional area of the supply line conduit 58, by proper selection of the bleed orifice 128.

We claim:

1. A method of distributing fuel in a diesel engine system in which fuel in a fuel tank having an air space above a fuel level is pumped, during operation of the engine, to a fuel injection system disposed in spaced relation above the fuel tank via a fuel supply line, and excess fuel is returned to the fuel tank, comprising the steps of:

providing fuel return line means which divides into first and second fuel flow paths at a predetermined dividing point, with the first fuel flow path returning fuel to the fuel supply line, and with the second fuel flow path defining an uninterrupted, gravity driven, fluid flow path between the predetermined dividing point of the fuel return line means and the air space of the fuel tank, returning fuel to the air space of the fuel tank via the second fuel flow path of the fuel return line means, and sizing the cross sectional area of the second fuel flow path of the fuel return line means such that, during non-operation of the diesel engine, air from the fuel tank air space flows counter to fuel returning to the fuel tank by gravity, to maintain the space vacated by returning fuel near atmospheric pressure.

2. The method of claim 1 wherein the second fuel flow path of the fuel return line means includes a conventional fuel return line conduit, with the step of sizing the cross sectional area of the return line means including the step of providing an additional return line conduit from the predetermined dividing point of the fuel return line means to the air space of the fuel tank, in parallel with the conventional fuel line conduit of the second fuel flow path.

3. The method of claim 1 wherein the step of sizing the cross sectional area of the second fuel flow path of the fuel return line means includes the step of providing first and second fuel return line conduits connected in parallel between the predetermined dividing point of the fuel return line means and the air space above the fuel tank.

4. A method of distributing fuel in a diesel engine system in which fuel in a fuel tank having an air space above a fuel level is pumped, during operation of the engine, to a fuel injection system disposed in spaced relation above the fuel tank, and excess fuel is returned to the fuel tank, with the diesel engine system including fuel filter means, comprising the steps of:

providing fuel return line means having first and second output branches which define an uninterrupted fluid flow path between the injection system and the air space of the fuel tank, returning fuel to the air space of the fuel tank via the fuel return line means, and sizing the cross sectional area of the fuel return line means such that, during non-operation of the diesel engine, air from the fuel tank air space flows counter to fuel returning to the fuel tank by gravity, to maintain the space vacated by returning fuel near atmospheric pressure, said step of sizing the return line means including the steps of:

providing a single return line conduit between the first output branch of the return line means and the air space of the fuel tank, connecting the second output branch to the fuel filter means, providing a restriction in the second branch of the return line means, and sizing the cross sectional area of the single return line conduit such that the sizing of the single return line conduit and the step of providing a restriction in the second output branch of the fuel return line means cooperatively maintain the space vacated by returning fuel near atmospheric pressure.

5. A method of distributing fuel in a diesel engine system in which fuel in a fuel tank having an air space above a fuel level is pumped, during operation of the engine, to a fuel injection system disposed in spaced relation above the fuel tank via a fuel supply line, and excess fuel is returned to the fuel tank, comprising the steps of:

providing fuel return line means which divides into first and second fuel flow paths at a predetermined dividing point, with the first fuel flow path returning fuel to the fuel supply line, and with the second fuel flow path defining a gravity driven flow path between the predetermined dividing point of the fuel return line means and the air space of the fuel tank, providing the second fuel flow path of the fuel return line means by the step of providing first and second fuel return lines connected in parallel between the predetermined dividing point of the fuel return line means and the air space of the fuel tank, and sizing the first and second fuel return lines such that the sum of their cross sectional areas relative to the rate at which fuel is returned to the fuel tank by gravity during non-operation of the diesel engine, enables air from the fuel tank air space to flow counter to returning fuel, to maintain the space vacated by returning fuel near atmospheric pressure.

6. The method of claim 5 wherein the fuel supply line includes a single fuel supply line connected between the fuel tank and injection system, with the step of sizing the first and second fuel return lines providing a total cross sectional area which exceeds the cross sectional area of the single fuel supply line.

7. A method of distributing fuel in a diesel engine system in which fuel in a fuel tank having an air space above a fuel level is pumped via a fuel supply line and fuel filter means, during operation of the engine, to a fuel injection system disposed in spaced relation above the fuel tank, and excess fuel is returned to the fuel tank via a single return line, and also to the fuel filter means, comprising the steps of:

returning fuel to the air space in the fuel tank via the single return line, restricting the rate at which fuel is returned to the fuel filter means, and sizing the return line such that the selected cross sectional area of the return line and the step of restricting the fuel return rate to the fuel filter means cooperatively enable air from the fuel tank air space to flow counter to fuel returning to the fuel tank by gravity during non-operation of the diesel engine, to maintain the space vacated by returning fuel near atmospheric pressure.

8. The method of claim 7 wherein the sizing step provides substantially equal cross sectional areas in the fuel supply line and in the fuel return line.

9. In a diesel engine system in which fuel in a fuel tank having an air space above a fuel level is pumped, during operation of the engine, to a fuel injection system disposed in spaced relation above the fuel tank via a fuel supply line, and excess fuel is returned from the engine via fuel return line means which divides into first and second fuel flow paths at a predetermined dividing point, with the first fuel flow path returning fuel to the fuel supply line, add with the second fuel flow path defining an uninterrupted, gravity driven, fuel flow path between the predetermined dividing point of the fuel return line means and the fuel tank, the improvement comprising:

means connecting the second fuel flow path of the fuel return line means to return fuel to the fuel tank air space, said second fuel flow path of the fuel return line means having a cross sectional area selected to enable air from the fuel tank air space to flow counter to fuel returning to the fuel tank by gravity during non-operation of the diesel engine, to maintain the space vacated by returning fuel near atmospheric pressure.

10. The diesel engine system of claim 9 wherein the second fuel flow path of the fuel return line means includes first and second fuel line conduits connected in parallel between the predetermined dividing point of the fuel return line means and the air space of the fuel tank.

11. The diesel engine system of claim 10 wherein the combined cross sectional areas of the first and second fuel line conduits exceeds the cross sectional area of the fuel supply line.

12. In a diesel engine system in which fuel in a fuel tank having an air space above a fuel level is pumped, during operation of the engine, to a fuel injection system disposed in spaced relation above the fuel tank, and excess fuel is returned to the fuel tank via fuel return line means which defines an uninterrupted fluid flow path between the injection system and the fuel tank, the improvement comprising:

means connecting the fuel return line means to return fuel to the fuel tank air space, said return line means having a cross sectional area selected to enable air from the fuel tank air space to flow counter to fuel returning to the fuel tank by gravity during non-operation of the diesel engine, to maintain the space vacated by returning fuel near atmospheric pressure, said fuel being pumped through fuel filter means, said return line means including a first output branch which includes a single return line conduit connected between the injection system and the air space of the fuel tank, and a second branch which returns fuel to the fuel filter means, and including restriction means in the second branch of the return line means which limits the rate at which fuel is returned to the fuel filter assembly, with the cross sectional areas of the single return line conduit and restriction means cooperatively maintaining the space vacated by returning fuel near atmospheric pressure.

13. The diesel engine system of claim 12 including a fuel supply line, with the cross sectional areas of the fuel supply line and the single return line being substantially equal.

14. In a diesel engine system in which fuel in a fuel tank having an air space above a fuel level is pumped, during operation of the engine, to a fuel injection system disposed in spaced relation above the fuel tank via a fuel supply line, and excess fuel is returned from the engine via fuel return line means which divides into first and second fuel flow paths at a predetermined dividing point, with the first fuel flow path returning fuel to the fuel supply line, and with the second fuel flow path returning fuel to the fuel tank, the improvement comprising:

first and second fuel return lines connected in parallel between the predetermined dividing point of the fuel return line means and the air space in the fuel tank, said first and second fuel return lines having cross sectional flow areas selected such that the sum of their cross sectional areas relative to the rate at which fuel is returned to the fuel tank via the first and second fuel return lines by gravity during non-operation of the diesel engine enables air from the fuel tank to flow counter to returning fuel, to maintain the space vacated by returning fuel near atmospheric pressure.

15. In a diesel engine system in which fuel in a fuel tank having an air space above a fuel level is pumped via a delivery line through fuel filter means, during operation of the engine, to a fuel injection system disposed in spaced relation above the fuel tank, and excess fuel is returned to the fuel filter means via a first output branch of the fuel return means, and to the to the fuel tank via a second branch of the fuel return means which includes a single return line, the improvement comprising:

means connecting the return line to the fuel tank such that fuel is returned to the air space in the fuel tank, and means restricting the rate at which fuel is returned to the fuel filter means via the second output branch of the fuel means, said return line having a cross sectional area selected to enable air from the fuel tank air space to flow counter to the flow of fuel returning to the fuel tank, to maintain the space vacated by returning fuel near atmospheric pressure.

* * * * *